United States Patent [19]

Anderson et al.

[11] 4,112,692

[45] Sep. 12, 1978

[54] SOIL COMPACTION SYSTEM

[76] Inventors: Lowell M. Anderson, 5422 Panorama Dr., Huntsville, Ala. 35801; William D. Simmons, 1216 Seventh St., Long Beach, Miss. 39560

[21] Appl. No.: 808,299

[22] Filed: Jun. 20, 1977

Related U.S. Application Data

[62] Division of Ser. No. 24,207, Mar. 31, 1970, abandoned.

[51] Int. Cl.[2] ..... E02D 3/12

[52] U.S. Cl. ..... 405/271; 175/19

[58] Field of Search ..... 61/35, 36, 63, 53.5, 61/53; 175/19

[56] References Cited

U.S. PATENT DOCUMENTS

| | | | |
|---|---|---|---|
| 3,204,414 | 9/1965 | Steuerman | 61/36 R |
| 3,282,055 | 11/1966 | Landau | 175/19 X |
| 3,344,873 | 10/1967 | Baittinger | 175/19 X |
| 3,344,874 | 10/1967 | Bodine | 175/19 X |

FOREIGN PATENT DOCUMENTS

| | | | |
|---|---|---|---|
| 431,069 | 7/1935 | United Kingdom | 61/53 |

*Primary Examiner*—Philip C. Kannan
*Attorney, Agent, or Firm*—Stuart J. Friedman

[57] ABSTRACT

A method of compacting granular material with continuously vibrating a hollow pipe. The vibrating pipe is lowered into the material to be compacted with a crane type apparatus, maintained in a lowered position for a period of time and then withdrawn from the material. The vibration imparted to the material is increased by a number of annular rings located along the outer surface of the vibrating pipe.

20 Claims, 5 Drawing Figures

Fig. 1
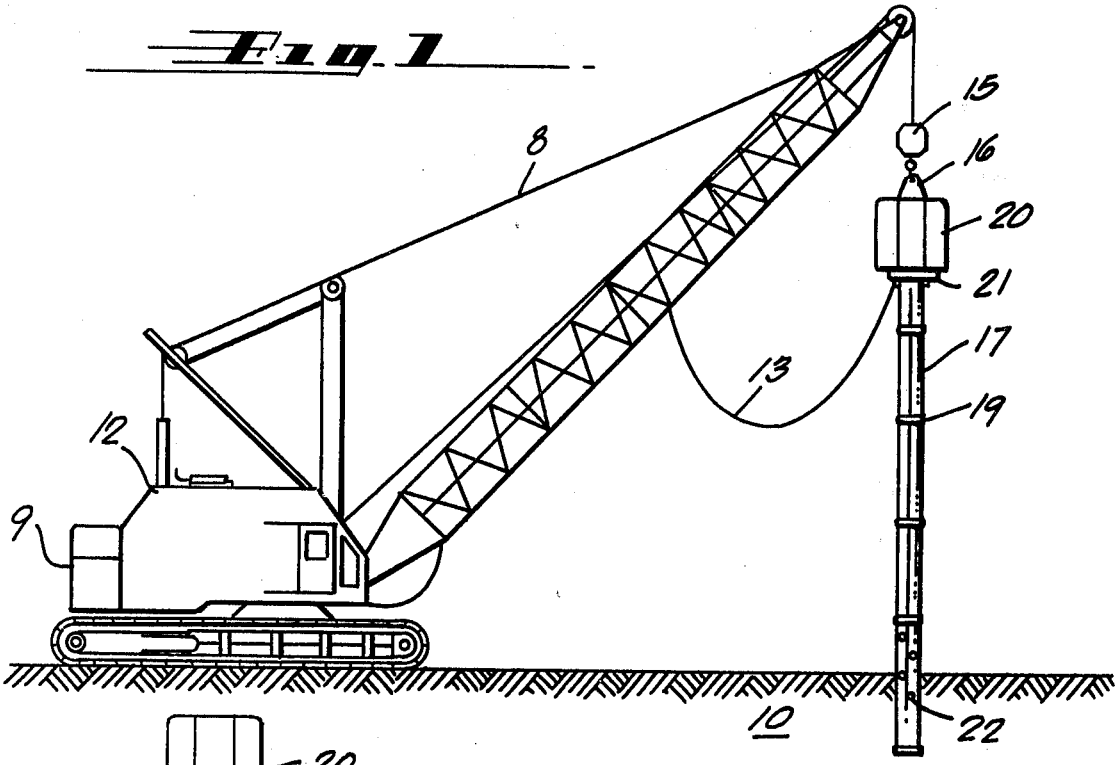
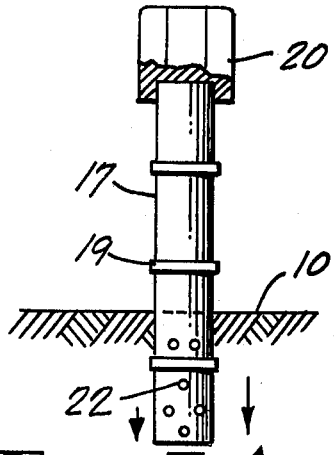
Fig. 3A
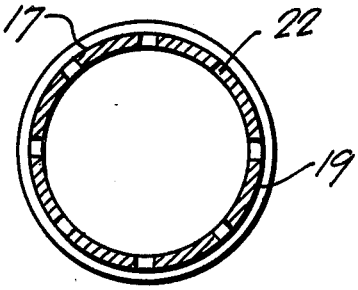
Fig. 2
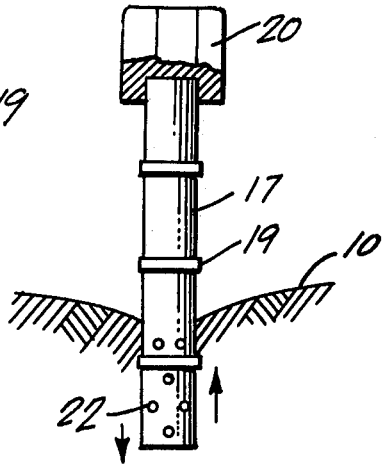
Fig. 3C
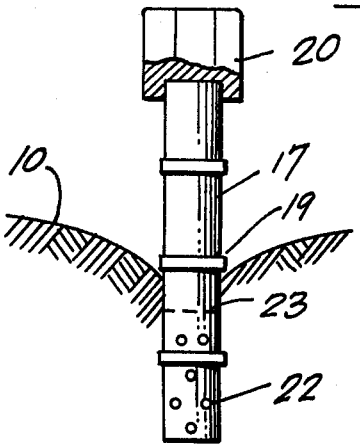
Fig. 3B

SOIL COMPACTION SYSTEM

This is a division of application Ser. No. 024,207 filed Mar. 31, 1970, now abandoned.

BACKGROUND OF THE INVENTION

Because of the shortage of usable land in industrial areas, especially along waterfront sites, there has been a recent trend towards building large industrial complexes, such as power plants, steel mills, and, of course, shipyards on landfill sites. Additionally, there are several projects presently being planned for construction of large intercontinental airports on landfill sites along the coasts of the United States and the Great Lakes.

In conventional landfill construction projects, the fill is generally provided by depositing relatively solid dry materials along the ocean or water bed, or in the case of swamp land, depositing clean dryfill along the swamp until a firm foundation had been established. Due to the enormous expense of trucking in fill, and the time and material necessary, the costs involved for conventional landfilling have become almost prohibitive when compared to the actual costs of the buildings and facilities constructed on the filled areas.

Recently, new techniques of landfilling have been developed involving the hydraulic sandfilling of swampy or underwater sites. Generally, this method uses a slurry of earth and water from a nearby ocean or lake bed which is hydraulically pumped through a large pipe to the fill site. The slurry is deposited on the fill site and the water drains away, depositing the solid material. With this method it is possible to simultaneously dredge the adjacent river or ocean bed while using the fill area as a depository for the dredged material.

When hydraulic landfill is used, the material, which is generally granular in nature, must first be compacted prior to commencing any construction thereon. This fill can be compacted by allowing the sand to naturally settle over a sufficiently long period of time, usually a matter of months or years, depending on the degree of compaction needed, which in turn is dependent upon the type of material and the weight of any contemplated construction. Alternatively, mechanical means can be used to force the water out of the sand thereby achieving compaction. Generally, this involves large rolling drums, which are rolled back and forth over the material, compacting it as it is deposited.

When hydraulic landfill is used, continual mechanical compaction is sometimes impossible because of the high fluid consistency of the fill immediately after it is deposited. Even when sufficient drainage has occurred, rolling is time consuming and generally ineffective for sufficient compaction at substantial depths. Natural settlement is unsatisfactory because of the amount of time necessary during which no construction can take place.

Because hydraulic landfill projects will often require use of up to 20 or 30 feet of fill to form a sufficient base for a foundation, it is necessary that the compaction be uniformly achieved to substantial depths. This becomes especially important in situations where large facilities are to be subsequently constructed. Pounding or rolling the surface to effect compaction will not really provide a sufficient degree of compaction more than a few feet below the surface and it becomes necessary to have some sort of soil penetrating device to compact the soil lower down.

Prior soil compaction systems applicable to hydraulically filled areas and which provide sufficiently deep penetration have employed one of the varying types of penetrating torpedo-type devices which are solid in nature and are lowered down through the soil to some depth. Once lowered, the particular device is set into vibration by a rotating eccentric or other appropriate means, thereby compacting the soil. These prior devices have proven unsatisfactory for certain applications in that they require a separate means for forcing them to a lowered position in the ground, and the hole through which the device is lowered and raised must be backfilled with uncompacted fill, once the device is withdrawn.

It is therefore an object of this invention to provide a method of compacting soil or other granular materials which will provide a relatively high degree of compaction.

Another object of the invention is to provide a method of compacting soil or other granular material which will provide a high degree of compaction to relatively large depths.

Another object of the invention is to provide a method of compacting soil or other granular material which will not require additional material to backfill holes through which the compacting device is lowered into the soil.

Another object of the invention is to provide a method of compacting soil or other granular material which can be operated with a minimum expenditure of time and manpower.

Another object of the invention is to provide an apparatus for the compaction of soil or other granular materials.

SUMMARY OF THE INVENTION

A method and apparatus for the compaction of granular material comprising an elongated hollow member which is set into vibration by a constant vibrating hammer, the member and hammer being suspended from a crane-like apparatus. While in constant vibration, the member is lowered into the ground in a substantially vertical position to a predetermined depth, maintained in the lowered position for a period of time, and then withdrawn. The same procedure is repeated at a plurality of locations.

BRIEF DESCRIPTION OF THE DRAWINGS

The aforementioned objects of the invention will be further apparent from the following detailed description, reference being made to the accompanying drawings, in which:

FIG. 1 is a schematic representation of one embodiment of the compaction apparatus in accordance with the invention;

FIG. 2 is a plan view of a hollow member used in one embodiment of the invention for the compaction of soil or granular materials; and FIGS. 3(*a*), 3(*b*) and 3(*c*), show the method of compacting granular materials with the apparatus of FIG. 1.

DESCRIPTION OF THE PREFERRED EMBODIMENTS

FIG. 1 is a schematic representation of one embodiment of a compaction apparatus. An elongted hollow member is used to perform the actual compaction. The hollow member can be of any cross-section configuration, but would typically be a hollow cylindrical pipe 17 shown in FIG. 1. A vibrating device 20 is securely fastened to the upper end of the pipe 17 by a coupling arrangement 21. Depending on the particular vibrator and coupling arrangement used, the vibrator can be attached to the pipe 17 at any position which will enable it to set the pipe into vibration.

During operation of the apparatus in FIG. 1, the vibrating device 20 will be set into vibration thereby imparting through the fixed coupling 21 a vibration to the pipe 17. The vibrating device 20 creates a vibration in pipe 17 which is substantially parallel to its longitudinal axis. Depending upon the length, width and thickness of the particular pipe used, a wave-like harmonic action will be set up in the pipe, the frequency of the pipe vibration being dependent upon the particular parameters of the individual pipe. The degree and frequency of vibration of the pipe as well as the depth of penetration will have some effect on the degree of compaction achieved during the use of the system, and optimum results can best be achieved by trial and error experimentation with the particular material to be compacted.

The vibrating device 20 and pipe 17 are supported and controlled by a crane apparatus 12. The hammer and pipe are supported from the crane 12 by a cable 8 having a block 15 disposed at its end thereof. To prevent the vibrations from the device 20 being imparted to the crane cable 8, and power equipment within the crane 12, a damper 16 of the well known vibration damping variety is disposed between the block 15 and the vibrating device 20. A generator 9 located at the rear portion of the crane 12 supplies the necessary electrical or pneumatic power through cables 13 to the vibrating device 20. The compaction apparatus is thereby fully portable and can be moved from location to location as needed.

The pipe 17 has a series of annular metal rings 19 located along the outer surface of the cylindrical pipe 17 at spaced intervals along the length of the pipe. These rings or equivalent vibration increasing means are built into or welded to the pipe 17 and are used to increase the efficiency of the vibrating action during the compacting process. Similarly, a series of small holes 22 may be drilled in the lower portion of the pipe to provide some added efficiency to the compaction process as well as improve drainage during compaction. These holes are in no way necessary to provide compaction and they are not in any way intended to limit the scope of this invention. The increased efficiency achieved with the use of the rings 19 will depend on the particular type of material compacted and the depth of penetration of the pipe 17.

FIG. 2 is a cross-sectional view of the pipe 17 shown in FIG. 1. A number of annular rings 19 are shown fastened along the outer surface of pipe 17. Additionally, a series of holes 22 can be drilled in the lower portion of the pipe 17 to facilitate compaction. As previously mentioned, it is not necessary that pipe 17 be of a circular cross-section, an elliptical or polygonal cross-section being equally contemplated as falling within the scope of the invention. Typically, the pipe 17 might be of $\frac{3}{8}$ inch or $\frac{1}{2}$ inch thickness with an internal diameter of 30 inches. The length may be of 60 feet or more, depending on the depth of compaction necessary.

The method of compacting sand with the apparatus as shown in FIG. 1 is illustrated in FIGS. 3(*a*), 3(*b*) and 3(*c*). In FIG. 3(*a*), the pipe 17 is shown being vibrated by the vibrating hammer 20. The vibrations of hammer 20 and the pipe 17 are constant and continuous during the period the pipe 17 is penetrating the compacted material this continuity of vibration being an integral part of the instant invention. As the pipe is vibrating, the crane apparatus 12 lowers the hammer and pipe on to the surface to be compacted at a particular location. The combination of the weight of the pipe 17 and hammer 20, and the vibratory effect of the pipe allows the pipe to burrow itself into the ground in a substantially vertical position. When typical granular-like materials are being compacted, no additional force is needed to urge the pipe downward into the material.

The pipe is lowered to the appropriate depth of the material to be compacted. It is maintained in this lowered position for a predetermined period of time, normally a matter of minutes, as shown in FIG. 3(*b*) and then slowly withdrawn as illustrated in FIG. 3(*c*).

Tests have shown that use of the aforementioned described method of compacting granular material, such as sand, results in a diminishing concentric ring of settlement which occurs around the pipe as it is lowered into the ground, maintained at its lowered position and then withdrawn.

As shown in FIG. 3(*c*) the compaction of the soil 10 around the pipe 17 is not uniform because the magnitude of the vibrating effect is inversely proportional to the radial distance from the pipe. The distribution of the magnitude of vibration causes the material closer to the pipe to undergo a higher degree of compaction than material some distance from the pipe. The greater compaction near the surface of the pipe causes the surface of the soil 10 to be displaced downward, as shown in FIGS. 3(*b*) and 3(*c*). Because of the even greater compaction within the pipe 17, the compacted soil level 23 within the pipe is lower than the level surrounding the pipe 17.

Where a pipe of approximately 36 inches in diameter is used, driven to a depth of approximately 60 feet, the concentric ring of settlement occurred around the pipe for a diameter of approximately 20 feet. Due to the high degree of compaction around the pipe, any liquid within the granular material will be forced to the surface as the material is compacted.

In order to achieve uniform compaction over a large area, it will be necessary to lower the vibrating pipe into the compaction at a number of variably placed locations. Because of the concentric settlement effect described above, uniform compaction can be achieved over a large area by the use of any uniform pattern of locations. A typical pattern of compaction would be to line up the centers of compaction in rows. The distance between the centers will best be determined by experimenting with the apparatus for a particular combination of depth to be compacted, degree of compaction necessary, material, and the pipe parameters.

The described method has numerous advantages over previous compacting processes. Because the apparatus is extremely simple to operate, compaction can proceed with only one operator who can simultaneously control the power to the vibrating hammer and the location of the apparatus. The apparatus used is fully portable and the compacting apparatus can be quickly and easily moved from one location to the next with a minimum of time and trouble. Similarly, because the vibrating hammer is continuously vibrating, there is no need for stop/start operation which would tend to increase wear and tear on all the personnel and equipment used.

The use of the hollow vibrating member in the present system almost totally alleviates the need to backfill the hole through which the apparatus was lowered into the ground. As mentioned above, the only backfill necessary would be to fill in the top portion of the highly compacted core area of the pipe. The degree of fill needed for this operation is minimal.

The simplicity of the instant apparatus, makes it extremely economical to operate. With the exception of the vibrating hammer, which may need periodic maintenance, the apparatus used for compaction is almost indestructable. The pipe is typically made of a high grade steel and while it is susceptible to some wearing due to the frictional action of the granular material along its surface, this wear is minimal over any period of time. Where the rings 19 are fastened along the surface of the pipe, they would be made of a similarly strong and wear-resistent material.

It should therefore be apparent that this invention results in a method of compacting granular materials which is far superior, simpler and more economical than previous methods used.

We claim as our invention:

1. Vibratile apparatus for deep sub-surface compaction of granular soil material using continuously applied vibrational energy, comprising (a) probe means for transmitting a wave-like harmonic vibrational motion below the surface of the granular soil material when subjected to the continuously applied vibrational energy, said probe means including an elongated thin-walled member having opposed lateral surfaces separated only by the wall thickness of said elongated thin-walled member and having a substantially uniform cross-sectional shape perpendicular to its longitudinal axis, said elongated thin-walled member being shaped for insertion endwise into the granular soil material to cause both said opposed lateral surfaces to contact directly and transmit vibrational energy into the granular soil material to cause compaction of the granular soil material on both sides of said elongated thinwalled member; and (b) vibration increasing means attached to one of said lateral surfaces of said elongated thin-walled member for increasing the amount of vibrational energy conveyed into the granular soil material adjacent said one lateral surface while the other said lateral surface of said thin-walled member is still in contact with the granular soil material, said vibration increasing means including at least one continuous raised lateral projection extending outwardly across the full horizontal extent of said one lateral surface when said probe means is inserted into the granular material.

2. Vibratile apparatus, as claimed in claim 1, wherein the length, width and thickness of said elongated thin-walled member are selected to optimize the wave-like harmonic motion transmitted by said probe means.

3. Vibratile apparatus, as claimed in claim 1, wherein said elongated thin-walled member cross-sectional dimensions are substantially uniform along its length.

4. Vibratile apparatus, as claimed in claim 1, wherein the cross-sectional shape of said elongated thin-walled member is circular.

5. Vibratile apparatus, as claimed in claim 1, wherein said elongated thin-walled member is hollow.

6. Vibratile apparatus, as claimed in claim 5, wherein said elongated thin-walled member is a cylindrical pipe.

7. Vibratile apparatus, as claimed in claim 1, wherein said vibration increasing means includes a plurality of separate continuous raised lateral projections extending across the full horizontal extent of said one lateral surface when said probe means is inserted into said granular soil material.

8. Vibratile apparatus, as claimed in claim 7, wherein said elongated thin-walled member is a thin-walled tube having open ends with said opposed lateral surfaces being the inner and outer surfaces of said tube and said one continuous raised lateral projection is a collar connected with said outer surface of said tube.

9. Vibratile apparatus, as claimed in claim 8, wherein said vibration increasing means includes a plurality of collars connected with said outer surface of said tube spaced along the longitudinal axis of said elongated thin-walled member.

10. Vibratile apparatus, as claimed in claim 9, wherein said tube is an integral one piece member having no sectional joints intermediate the ends thereof.

11. Vibratile apparatus, as claimed in claim 9, wherein said tube includes a plurality of holes disposed about the surface thereof between said collars.

12. Vibratile apparatus, as claimed in claim 11, wherein said plurality of holes is disposed generally adjacent the end of said tube.

13. Vibratile apparatus, as claimed in claim 12, wherein said tube is a cylindrical pipe.

14. A vibratile system for deep sub-surface compaction of granular soil material using continuously applied vibrational energy, comprising (a) vibrating means for continuously creating vibrations at a predetermined frequency;

(b) probe means for transmitting a wave-like harmonic vibrational motion below the surface of the granular soil material when subjected to the vibrational energy created by said vibrating means, said probe means including an elongated thin-walled member having opposed lateral surfaces separated only by the wall thickness of said elongated thin-walled member and having a substantially uniform cross-sectional shape perpendicular to its longitudinal axis;

(c) coupling means for coupling said vibrating means to said elongated thin-walled member to cause said member to vibrate continuously at substantially the same frequency as said vibratory means in a direction substantially parallel to the longitudinal axis of said elongated thin-walled member;

(d) support means for supporting said vibrating means, said probe and said coupling means to cause said elongated thin-walled member to be inserted into and withdrawn from the granular soil material to cause both said lateral surfaces to contact, vibrate and compact the granular soil material while said elongated thin-walled member is continuously vibrated by said vibration means through said coupling means; and (e) vibration increasing means attached to one of said lateral surfaces of said elongated thin-walled member for increasing the amount of vibrational energy conveyed into the granular soil material adjacent said one lateral surface while the other said lateral surface of said thin-walled member is still in contact with the granular soil material adjacent the other said lateral surface, said vibration increasing means including at least one continuous raised lateral projection extending outwardly across the full horizontal extent of said one lateral surface when said probe means is inserted into the granular material.

15. A vibratile system, as claimed in claim 14, wherein said elongated thin-walled member cross-sectional shape is configured to at least partially encompass the soil material immediately adjacent said probe means.

16. A vibratile system, as claimed in claim 14, wherein said elongated thin-walled member is an open ended tube, said opposed lateral surfaces being the inside and outside surfaces of said tube, and wherein said lateral projection is a collar attached to the outside surface of said tube.

17. A vibratile system, as claimed in claim 16, wherein said vibration increasing means includes a plurality of raised collars longitudinally spaced along the length of said tube.

18. A vibratile system, as claimed in claim 16, wherein said tube has a circular cross-sectional shape.

19. A vibratile system, as claimed in claim 16, wherein said tube includes a plurality of holes disposed about the surface thereof adjacent said collars.

20. A vibratile system, as claimed in claim 19, wherein said plurality of holes is disposed generally adjacent one end of said tube.

* * * * *